US005641110A

United States Patent [19]

Yang

[11] Patent Number: 5,641,110

[45] Date of Patent: Jun. 24, 1997

[54] STRUCTURE FOR CONNECTING A NAILING PLATE AND MAGAZINE OF A NAILING MACHINE

[75] Inventor: Peter Yang, Taichung Hsien, Taiwan

[73] Assignee: Testo Industry Corporation, Taipei, Taiwan

[21] Appl. No.: 588,486

[22] Filed: Jan. 18, 1996

[51] Int. Cl.[6] ..... B25C 1/04

[52] U.S. Cl. ..... 227/120; 227/8; 227/109

[58] Field of Search ..... 227/120, 109, 227/130, 8, 156

[56] References Cited

U.S. PATENT DOCUMENTS

| | | | |
|---|---|---|---|
| 4,304,349 | 12/1981 | Novak et al. | 227/109 |
| 4,389,012 | 6/1983 | Grikis et al. | 227/109 |
| 4,524,896 | 6/1985 | Morrell, Jr. | 227/109 |
| 4,621,758 | 11/1986 | Anstett | 227/109 |
| 4,903,880 | 2/1990 | Austin et al. | 227/120 |
| 5,096,109 | 3/1992 | Chen | 227/109 |

*Primary Examiner*—Scott A. Smith

*Attorney, Agent, or Firm*—Donald C. Casey

[57] ABSTRACT

A structure for connecting a nailing plate and magazine of a nailing machine includes a couple of corresponding baffle pieces respectively disposed at opposite longitudinal ends of the nailing plate, a couple of lugs located at both sides of one of the baffle pieces, and a connecting seat provided at a suitable position of the nailing plate. One side of the connecting seat is provided with through holes while the other side thereof is provided with a safety bar bracket. When the magazine is secured to the nailing plate, it may be restricted and positioned by the baffle pieces and the lugs. Locking screws are further used to securely lock the magazine to the connecting seat of the nailing plate.

1 Claim, 4 Drawing Sheets

STRUCTURE FOR CONNECTING A NAILING PLATE AND MAGAZINE OF A NAILING MACHINE

BACKGROUND OF THE INVENTION (a) Field of the Invention

The present invention relates generally to a connecting structure, and more particularly to a structure for connecting a nailing plate and a magazine of a nailing machine to ensure speedy, firm connection and smooth nailing and to reduce the weight of the magazine.

(b) Description of the Prior Art

Pneumatic nailing machines, widely used hand tools, mainly utilize a follow block to push nails onto a nailing plate where, by means of compressed air actuating a striking device, the nails are struck to drive speedily into a workpiece. The structure of a nailing plate and magazine of the conventional nailing machine is shown in FIGS. 1 and 2. The nailing plate consists of an upper plate 10 and a lower plate 20, both of which are screwably locked together by means of a plurality of locking screws 11. A magazine 30 has two parallel, connecting ribs 31, 31' formed on one side thereof, and these connecting ribs 31, 31' are respectively provided with screw holes 311, 311'. In order to secure the magazine 30 to the nailing plate, a plurality of screws 21 are passed through corresponding connecting holes 22 of the lower plate 20 into the screw holes 311, 311' of the magazine 30. Although such a manner of connection has been commonly adopted in the field, there are a number of drawbacks in actual use.

1. In order to properly secure the magazine 30 to the lower plate, a nail path 32 of the magazine has to align with a nail track 23 of the lower plate so that nails (not shown) may smoothly displace from the magazine 30 to the lower plate 20. If the connecting holes 22 of the lower plate 20 or the screw holes 311, 311' of the respective connecting ribs 31, 31' are not properly formed, although the lower plate 20 may still be firmly locked with the magazine 30, the nail path 32 and the nail track 23 cannot precisely align, resulting in easy nail jamming. A major reason underlying such a drawback is that there is not provided any guide elements to ensure the precise alignment of the guide path 32 and the guide track 23.

2. As the connecting ribs 31, 31' and the magazine 30 are integrally punched into shape so that the entire structure is a solid one, the weight of the magazine 30 as a whole is increased by the arrangement of the connecting ribs 31, 31'. Besides, screw holes have to be formed in the connecting ribs 31, 31', which is cost-and labor-consumptive.

3. Because the lower plate 20 is screwably secured to the upper side of the magazine 30 by means of screws 21 inserted into the screw holes 311, 311', there is only a longitudinal connecting force, without any transverse support so that the connection between the lower plate 20 and the magazine 30 is not very satisfactory. After a period of time, they may easily become loosened if subjected to an external, transverse impact.

SUMMARY OF THE INVENTION

Accordingly, a primary object of the present invention is to provide a structure for connecting a nailing plate and magazine of a nailing machine, in which the nailing plate is provided with two baffle pieces located on opposite longitudinal ends thereof while two lugs are disposed on both sides of one of the baffle pieces for positioning and restricting the magazine connected to the nailing plate, a connecting seat having a pre-determined number of through holes and a safety bar bracket being arranged at suitable positions on the nailing plate, the magazine being screwably locked onto the connecting seat by means of locking screws, whereby the connection between the nailing plate and the magazine may be firm to permit smooth nail passage while the overall weight of the nailing plate and the magazine may be reduced.

Another object of the present invention is to provide a structure for connecting a nailing plate and a magazine of a nailing machine, in which the nailing plate may be formed by wax stripping so that the nailing plate as well as its baffle pieces, lugs, connecting seat and safety bar bracket may be integrally formed to simplify the process of machining and to reduce cost.

A further object of the present invention is to provide a structure for connecting a nailing plate and magazine of a nailing machine, in which a bracket located at a connecting seat of the nailing plate may be movably connected to a safety bar to better position the safety bar.

BRIEF DESCRIPTION OF THE DRAWINGS

The foregoing and other features and advantages of the present invention will be more clearly understood from the following detailed description and the accompanying drawings, in which.

DETAILED DESCRIPTION OF THE PREFERRED EMBODIMENT

The structure for connecting a magazine and a nailing plate according to the present invention is provided to improve on prior devices which have the drawbacks of poor connection, bulky appearance, material waste, and frequent nail jamming.

Figure 3:
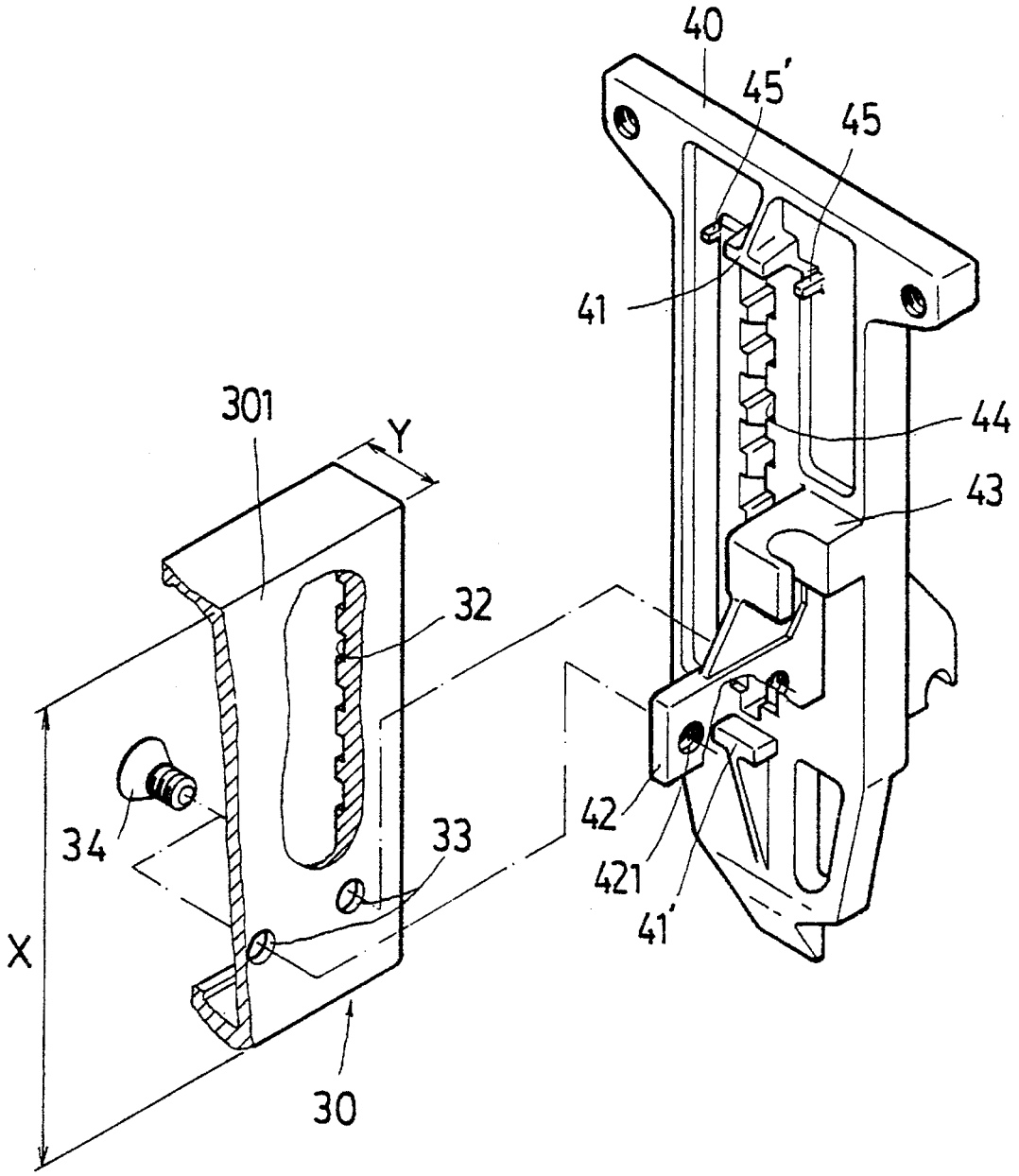
FIG. 3 is an elevational, exploded view of a preferred embodiment of a nailing plate and a magazine according to the present invention.
Figure 4:
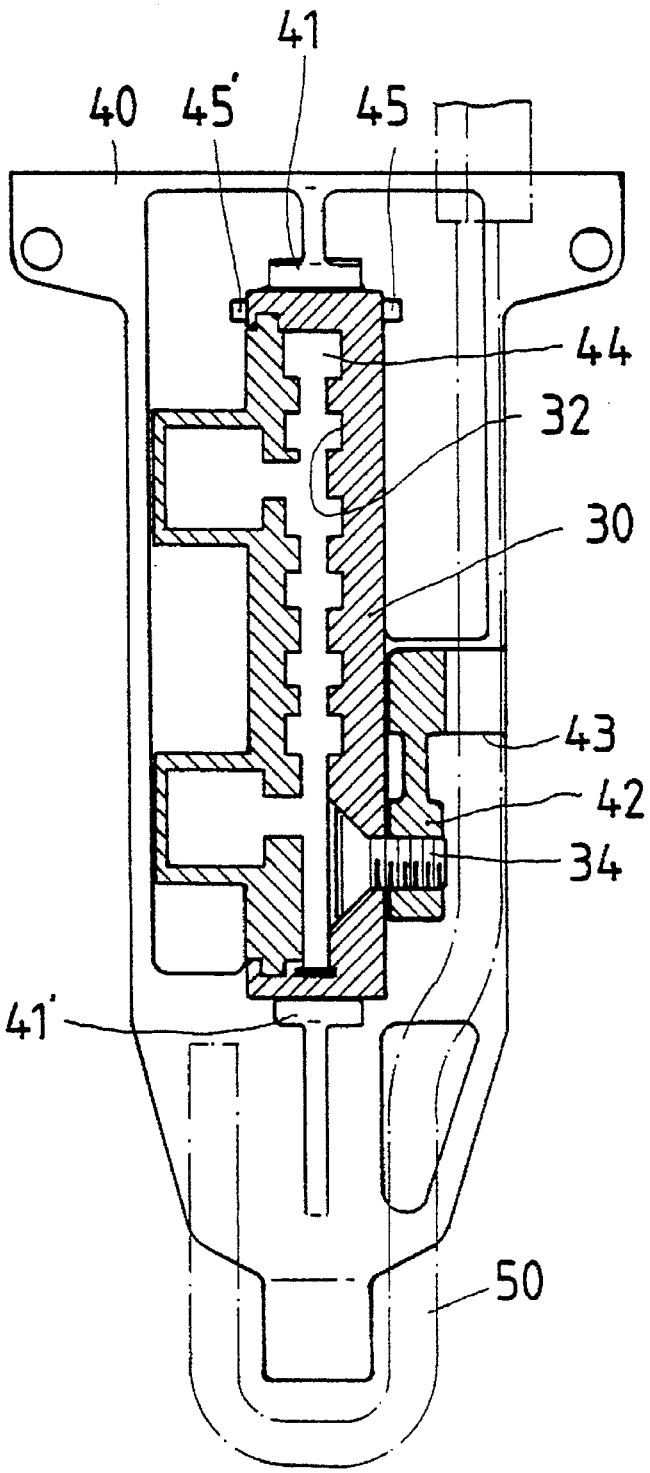
FIG. 4 is a schematic sectional view of FIG. 3, showing the nailing plate and the magazine in an assembled state.

With reference to FIG. 3, two baffle pieces 41 and 41' are respectively formed at suitable positions at opposite, longitudinal ends of a nailing plate 40 along a same central line. Two lugs 45 and 45' are disposed on both sides of the baffle piece 41. The distance between the two baffle pieces 41 and 41' is approximately equal to the height X of the magazine 30, while that between the lugs 45 and 45' is approximately equal to the width Y of the magazine 30 so that, when the magazine 30 is secured to the nailing plate 40, the magazine 30 may be restricted and firmly positioned by the baffle pieces 40 and 40' as well as the lugs 45 and 45'. In addition, the nailing plate 40 is provided with a connecting seat 42 and a safety bar bracket 43 at suitable positions adjacent to the baffle piece 41' and corresponding to a lower portion of the magazine 30. The connecting seat 42 is provided with a pre-determined number of transversely oriented through holes 421 in one side thereof such that the through holes 421 may align with a plurality of connecting holes 33 in a side 301 of the magazine 30 for receiving a plurality of locking screws 34.

When the nailing plate 40 is connected to the magazine 30, the magazine 30 is positioned between the baffle pieces 41 and 41' as well as the lugs 45 and 45'. After the locking screws 34 have been driven into the connecting holes 33 and the through holes 421 tightly, the magazine 30 and the nailing plate 40 may be firmly connected. A safety bar 50 may then be inserted through the safety bar bracket 43 and displace in a linear direction.

By means of the above-described arrangement, the following advantages may be achieved:

1. As the baffle pieces 41 and 41', the lugs 45 and 45', the connecting seat 42, the safety bar bracket 43 and the nailing plate 40 are integrally formed, when the magazine 30 is secured to the nailing plate 40, the lateral as well as the vertical sides of the magazine 30 may be firmly positioned by means of the baffle pieces 41, 41' and the lugs 45, 45', while the connecting seat 42 provides a transverse locking action on the magazine 30. Therefore, the magazine 30 may be restricted longitudinally and transversely on the nailing plate 40 to achieve good connection therewith.

2. When the magazine 30 is secured to the nailing plate 40, due to the restriction imposed thereon by the baffle pieces 41, 41', the lugs 45, 45', and the connecting seat 42, it is properly positioned in place so that a nail path 32 of the magazine 30 and a nail track 44 of the nailing plate 40 may precisely align, eliminating the nail jamming problem with prior devices due to imprecise machining of structural elements.

Figure 1:
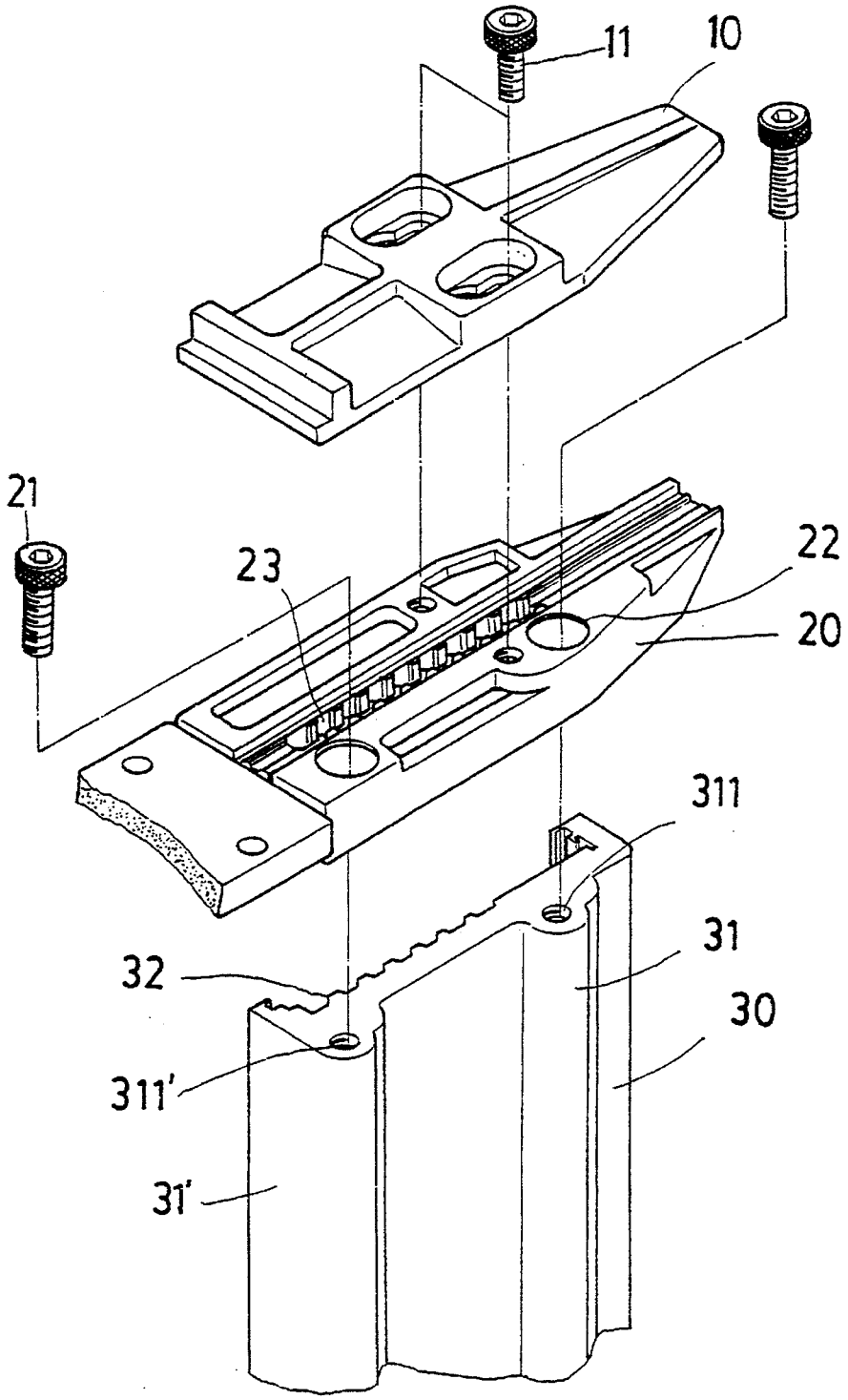
PRIOR ART FIG.1
FIG. 1 is an elevational, exploded view of a nailing plate and a magazine of a conventional nailing machine.
Figure 2:
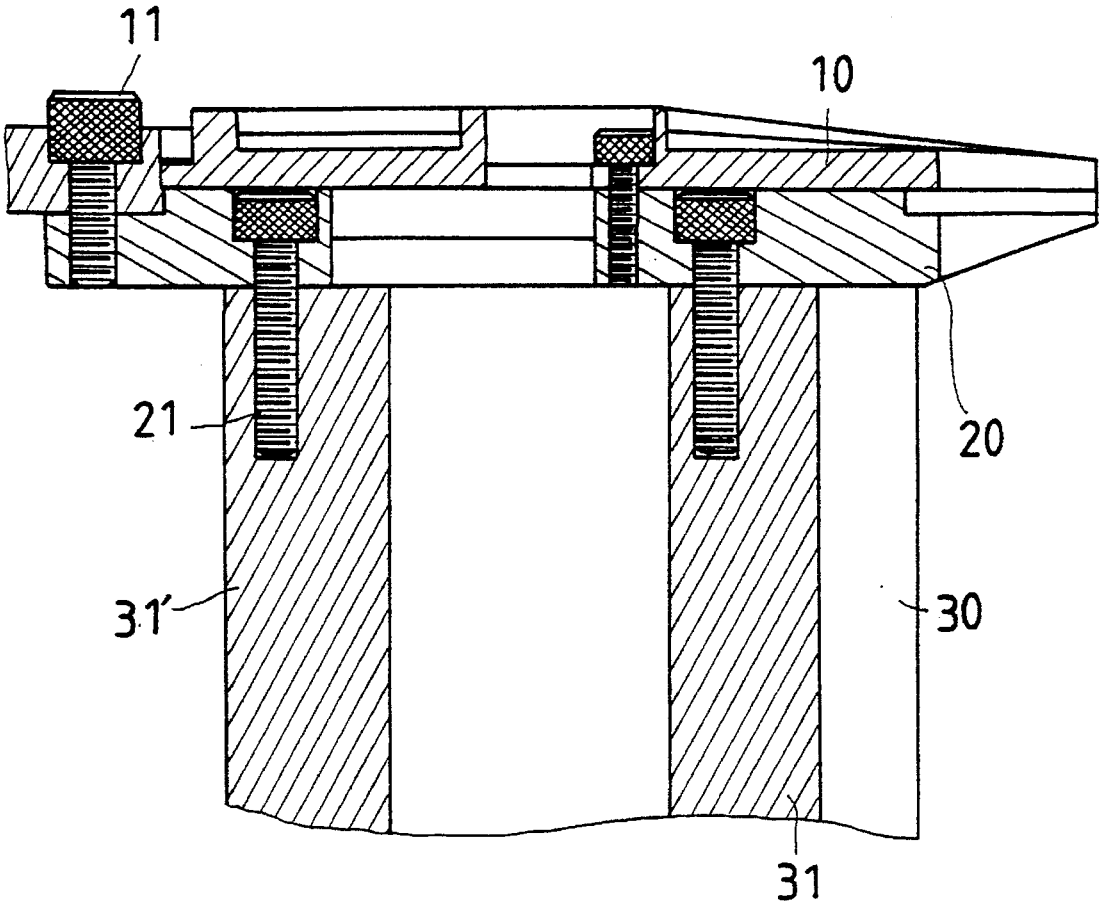
FIG. 2 PRIOR ART
FIG. 2 is a schematic sectional view of FIG. 1, showing the nailing plate and the magazine in an assembled state.

3. Since the magazine 30 according to the invention is not provided with a couple of connecting ribs 31, 31' as in the prior device shown in FIG. 1, the overall weight of the magazine may be reduced and the overall size may be more compact. Besides, as the total weight of the baffle pieces 41, 41', the lugs 45, 45', and the connecting seat 42 does not constitute a large proportion of the weight of the nailing plate 40, the overall weight of the nailing machine may be reduced to facilitate manipulation.

Although the present invention has been illustrated and described with reference to the preferred embodiment thereof, it should be understood that it is in no way limited to the details of such embodiment but is capable of numerous modifications within the scope of the appended claims.

What is claimed is:

1. A structure for connecting a nailing plate and a magazine of a nailing machine, comprising two corresponding baffle pieces respectively located at opposite, longitudinal ends of said nailing plate, two lugs respectively disposed at both sides of a first of said baffle pieces, and a connecting seat and a safety bar bracket arranged at suitable positions on said nailing plate, said connecting seat being provided with a pre-determined number of through holes, wherein a distance between said two corresponding baffle pieces and a distance between said two lugs are substantially equivalent to the respective height and width of said magazine having a plurality of connecting holes matching said through holes in number such that, when said magazine is secured to said nailing plate, said magazine may be longitudinally restricted and positioned by said lugs as well as said baffle pieces with said connecting seat abutting one side of said magazine such that said through holes of said connecting seat align with said connecting holes of said magazine so that a plurality of locking screws may be inserted through said connecting holes and said through holes to firmly lock said magazine onto said connecting seat of said nailing plate.

* * * * *